US009039142B2

(12) United States Patent
Mou et al.

(10) Patent No.: US 9,039,142 B2
(45) Date of Patent: May 26, 2015

(54) INK-JET PRINTING MODULE

(71) Applicant: MICROJET TECHNOLOGY CO., LTD, Hsinchu (TW)

(72) Inventors: Hao-Jan Mou, Hsinchu (TW); Ta-Wei Hsueh, Hsinchu (TW); Ying-Lun Chang, Hsinchu (TW); Kwo-Yuan Shi, Hsinchu (TW); Chin-Tsung Chen, Hsinchu (TW); Yung-Lung Han, Hsinchu (TW); Chi-Feng Huang, Hsinchu (TW)

(73) Assignee: MICROJET TECHNOLOGY CO., LTD., Hsinchu (TW)

( * ) Notice: Subject to any disclaimer, the term of this patent is extended or adjusted under 35 U.S.C. 154(b) by 0 days.

(21) Appl. No.: 13/689,336

(22) Filed: Nov. 29, 2012

(65) Prior Publication Data

US 2013/0328971 A1 Dec. 12, 2013

(30) Foreign Application Priority Data

Dec. 1, 2011 (TW) ..... 100144267 A
Oct. 9, 2012 (TW) ..... 101137220 A

(51) Int. Cl.
*B41J 2/14* (2006.01)
*B41J 2/175* (2006.01)
*B41J 2/155* (2006.01)

(52) U.S. Cl.
CPC *B41J 2/14* (2013.01); *B41J 2/1752* (2013.01); *B41J 2/17526* (2013.01); *B41J 2/155* (2013.01); *B41J 2002/14459* (2013.01); *B41J 2202/19* (2013.01); *B41J 2202/20* (2013.01)

(58) Field of Classification Search
CPC ..... B41J 2/155; B41J 2/0458; B41J 2/1752; B41J 2/17513
USPC ..... 347/13, 42, 49, 87
See application file for complete search history.

(56) References Cited

U.S. PATENT DOCUMENTS

| | | | | |
|---|---|---|---|---|
| 4,940,998 | A * | 7/1990 | Asakawa | 347/37 |
| 6,068,367 | A * | 5/2000 | Fabbri | 347/49 |
| 2013/0328972 | A1 * | 12/2013 | Mou et al. | 347/49 |

* cited by examiner

*Primary Examiner* — Justin Seo
(74) *Attorney, Agent, or Firm* — Kirton McConkie; Evan R. Witt

(57) ABSTRACT

An ink-jet printing module is used for a page-width array ink-jet printer. The ink jet printing module includes a page-width array platen and a plurality of ink-jet cartridges. The page-width array platen has a plurality of receiving cavities arranged as an array. Each of the ink-jet cartridges is detachably and independently embedded into one of the receiving cavities, and includes a body for storing ink, an ink-jet chip to be driven for ejecting the ink, a plurality of nozzles disposed on the ink-jet chip, and a control node for receiving signal to drive the ink-jet chip. The ink-jet chip is disposed on a bottom of the page-width array platen and is driven to eject the ink through the nozzles onto a printing medium.

21 Claims, 9 Drawing Sheets

INK-JET PRINTING MODULE

FIELD OF THE INVENTION

The present invention relates to an ink-jet printing module, and more particularly to an ink-jet printing module used for a page-width array ink-jet printer.

BACKGROUND OF THE INVENTION

There are two types of the carry mechanism for the common printing platen of the printer. One is performed with a transmission device. The ink-jet cartridge disposed on the carry mechanism is moved by the transmission device to scan along the direction of the transverse axis. The paper which is to be printed is moved by the paper delivery mechanism to pass under the ink-jet cartridge along the direction of the longitudinal axis, so as to eject ink from the ink-jet cartridge to the paper in the printing process.

The other one is a fixed typed carry mechanism of the printing platen. The width of the nozzle array on the printing platen is larger than or equal to the width of the paper which is to be printed. The nozzle array is fixed on the printing platen and the printing process is directly performed on the paper which is passed under the nozzle array. The printing mode is called the page-width array printing, and the plurality of ink-jet chips are arranged on the bottom of the carry mechanism of the printing platen. Although this kind of printing mode is convenient and efficiency, it still has the following disadvantages.

First, the plurality of ink jet chips are arranged on the bottom of the carry mechanism of the printing platen, and thus, if one of the ink-jet chips is damaged, the printing quality will be influenced. Moreover, since each ink-jet chip cannot be independently detached and changed, if one of the ink-jet chips is damaged, the whole printing platen has to be changed.

Second, to transport ink to each ink chamber communicated with each ink-jet chip of the page-width array platen, a complicated ink channel system has to be provided, and thus, the cost for design and manufacture will be increased.

Third, for manufacturing the page-width array platen, the ink-jet chips have to be mounted on the bottom of the carry mechanism one by one, so the circuit layout must be arranged and controlled in a complicated way and need complicated manufacturing process. Accordingly, the manufacturing time and cost must be increased.

Therefore, it is needed to provide an ink-jet printing module to overcome the above disadvantages.

SUMMARY OF THE INVENTION

The present invention provides an ink-jet printing module used for a page-width array ink-jet printer. The ink-jet printing module employs the plurality of ink-jet cartridges to be independently carried on the page-width array platen, so as to solve the problem that the whole printing platen has to be changed when one of the ink jet chips is damaged in the conventional page-width array ink-jet printer. According to the design of the present invention, the page-width array platen is more convenient in assembling, ink filling and cartridge changing, and has advantage of reducing the cost.

In accordance with an aspect of the present invention, there is provided an ink-jet printing module used for a page-width array ink-jet printer. The ink jet printing module includes a page-width array platen and a plurality of ink-jet cartridges. The page-width array platen has a plurality of receiving cavities arranged as an array. Each of the ink-jet cartridges is detachably and independently embedded into one of the receiving cavities, and includes a body for storing ink, an ink-jet chip to be driven for ejecting the ink, a plurality of nozzles disposed on the ink-jet chip, and a control node for receiving signal to drive the ink-jet chip. The ink-jet chip is disposed on a bottom of the page-width array platen and is driven to eject the ink through the nozzles onto a printing medium.

In accordance with another aspect of the present invention, there is provided an ink-jet printing module used for a page-width array ink-jet printer. The ink-jet printing module includes a page-width array platen, a plurality of ink-jet cartridges, and a plurality of control node circuits. The page-width array platen has a plurality of receiving cavities arranged as an array. Each of the ink-jet cartridges is detachably and independently embedded into one of the receiving cavities, and includes a body for storing ink, an ink-jet chip to be driven for ejecting the ink, a plurality of nozzles disposed on the ink-jet chip, and a control node for receiving signal to drive the ink-jet chip. The ink-jet chip is disposed on a bottom of the page-width array platen and is driven to eject the ink through the nozzles onto a printing medium. The control node circuits are disposed on vertical sidewalls of the receiving cavities on the page-width array platen and corresponding to the control nodes of the ink-jet cartridges for transmitting signal to the ink-jet chips of the ink-jet cartridges, so as to enable the ink-jet cartridges to eject the ink onto the printing medium.

The above contents of the present invention will become more readily apparent to those ordinarily skilled in the art after reviewing the following detailed description and accompanying drawings, in which:

DETAILED DESCRIPTION OF THE PREFERRED EMBODIMENT

The present invention will now be described more specifically with reference to the following embodiments. It is to be noted that the following descriptions of preferred embodiments of this invention are presented herein for purpose of illustration and description only. It is not intended to be exhaustive or to be limited to the precise form disclosed.

The present invention provides an ink-jet printing module used for a page-width array ink-jet printer. The ink-jet printing module includes a page-width array platen and a plurality of ink-jet cartridges. The page-width array platen is provided with a plurality of receiving cavities arranged as an array, each of which is used for independently carrying a single ink-jet cartridge, so as to solve the problem that the whole printing platen has to be changed when one of the ink jet chips is damaged in the conventional page-width array ink-jet printer. According to the design of the present invention, the page-width array platen is more convenient in assembling, ink filling and cartridge changing, and has advantage of reducing the cost.

Figure 1:
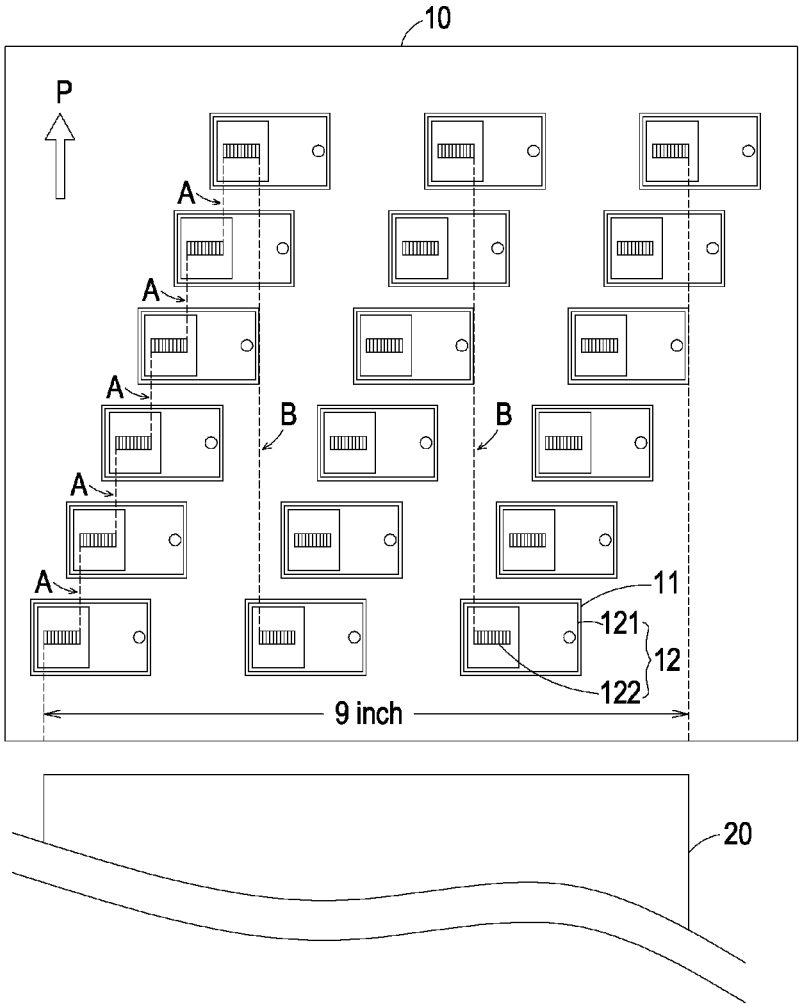
FIG. 1 shows a schematic view of an ink-jet printing module according to a preferred embodiment of the present invention.

Please refer to FIG. 1, which shows a schematic view of an ink-jet printing module according to a preferred embodiment of the present invention. As shown in FIG. 1, the ink-jet printing module includes a page-width array platen 10, which is arranged in a direction perpendicular to the width direction of the printing medium 20 (such as paper) delivered by the ink-jet printer. The page-width array platen 10 is provided with a plurality of receiving cavities 11 arranged as an array, and each of the plurality of ink-jet cartridges 12 is detachably and independently embedded into one of the receiving cavities 11. The ink-jet cartridge 12 includes a body 121 for storing ink, an ink jet chip 122 to be driven for ejecting the ink, a plurality of nozzles (not shown) disposed on the ink-jet chip 122, and a control node (not shown) for receiving signal to drive the ink-jet chip 122. The ink-jet chip 122 is disposed at the bottom of the page-width array platen 10, and is driven to eject the ink through the nozzles onto the printing medium 20. The plurality of nozzles on the ink-jet chip 122 are arranged as at least one row; for example, the plurality of nozzles are arranged as at least three rows.

In addition, the ink-jet printing module further includes a plurality of control node circuits (not shown), which are disposed on the vertical sidewalls of the receiving cavities 11 on the page-width array platen 10 and corresponding to the control nodes of the embedded ink-jet cartridges 12 for transmitting the signal to the ink-jet chips 122 of the ink-jet cartridges 12, so as to enable the ink-jet cartridges 12 on the page-width array platen 10 to eject ink onto the printing medium 20. For example, the plurality of control node circuits may be formed as a soft circuit board.

The present invention is illustrated with the following embodiments.

Embodiment 1

½ Inch & 1200 dpi Color Ink-Jet Cartridge

Please refer to FIG. 1. In this embodiment, the color ink-jet cartridges 12 (such as including red, yellow and blue inks) each having a chip size of ½ inch and a resolution of 1200 dpi are employed. As shown in FIG. 1, six ink-jet cartridges 12 are arranged in a row, and there are three rows of ink-jet cartridges 12 arranged in the printing direction (arrow P indicates the printing direction), so there are total eighteen ink-jet cartridges 12 disposed on the bottom of the page-width array platen 10. The ink-jet cartridges 12 are arranged to connect the ink-jet chips 122 thereof, so that the ink-jet chips 122 are distributed in the whole page width of the printing medium 20. More particularly, the adjacent ink-jet cartridges 12 in the same row are arranged in the way that the front end of the first (upper) ink-jet chip 122 is aligned with the rear end of the second (lower) ink-jet chip 122 (the aligning line is shown as the dotted line A, which is perpendicular to the width direction of the printing medium 20). While in different rows, the ink-jet cartridges 12 are arranged in the way that the rear end of the last (uppermost) ink-jet chip 122 in the first (left) row is aligned with the front end of the first (lowermost) ink-jet chip 122 in the second (right) row (the aligning line is shown as the dotted line B, which is perpendicular to the width direction of the printing medium 20). Accordingly, when the eighteen ink-jet cartridges 12 are disposed on the page-width array platen 10 in three rows as described above, the maximum printing range is 9 inches, so that a 1200 dpi multi-color printing process can be performed on the printing medium 20 having a width of 8.27 inches (210 mm, equal to the width of A4 paper) in this page-width array platen 10. Furthermore, for completing a dot supplementing printing, a solution is to equip additional and same eighteen ink-jet cartridges 12 on the page-width array platen 10 in the downstream of printing direction. In other words, there are two sets of eighteen ink-jet cartridges 12 disposed on the page-width array platen 10.

Embodiment 2

½ Inch & 600 dpi Black Ink-Jet Cartridge

Please also refer to FIG. 1. In this embodiment, the black ink-jet cartridges 12 each having a chip size of ½ inch and a resolution of 600 dpi are employed. As shown in FIG. 1, six ink-jet cartridges 12 are arranged in a row, and there are three rows of ink-jet cartridges 12 arranged in the printing direction (arrow P indicates the printing direction), so there are total eighteen ink-jet cartridges 12 disposed on the bottom of the page-width array platen 10. The ink-jet cartridges 12 are arranged to connect the ink-jet chips 122 thereof, so that the ink-jet chips 122 are distributed in the whole page width of the printing medium 20. More particularly, the adjacent ink-jet cartridges 12 in the same row are arranged in the way that the front end of the first (upper) ink-jet chip 122 is aligned with the rear end of the second (lower) ink-jet chip 122 (the aligning line is shown as the dotted line A, which is perpendicular to the width direction of the printing medium 20). While in different rows, the ink-jet cartridges 12 are arranged in the way that the rear end of the last (uppermost) ink-jet chip 122 in the first (left) row is aligned with the front end of the first (lowermost) ink-jet chip 122 in the second (right) row (the aligning line is shown as the dotted line B, which is perpendicular to the width direction of the printing medium 20). Accordingly, when the eighteen ink-jet cartridges 12 are disposed on the page-width array platen 10 in three rows as described above, the maximum printing range is 9 inches, so that a 600 dpi single-color printing process can be performed on the printing medium 20 having a width of 8.27 inches (210 mm, equal to the width of A4 paper) in this page-width array platen 10. Furthermore, for completing a dot supplementing printing, a solution is to equip additional and same eighteen ink-jet cartridges 12 on the page-width array platen 10 in the downstream of printing direction. In other words, there are two sets of eighteen ink-jet cartridges 12 disposed on the page-width array platen 10.

Embodiment 3

½ Inch & 1200 dpi Color Ink-Jet Cartridge

Figure 2:
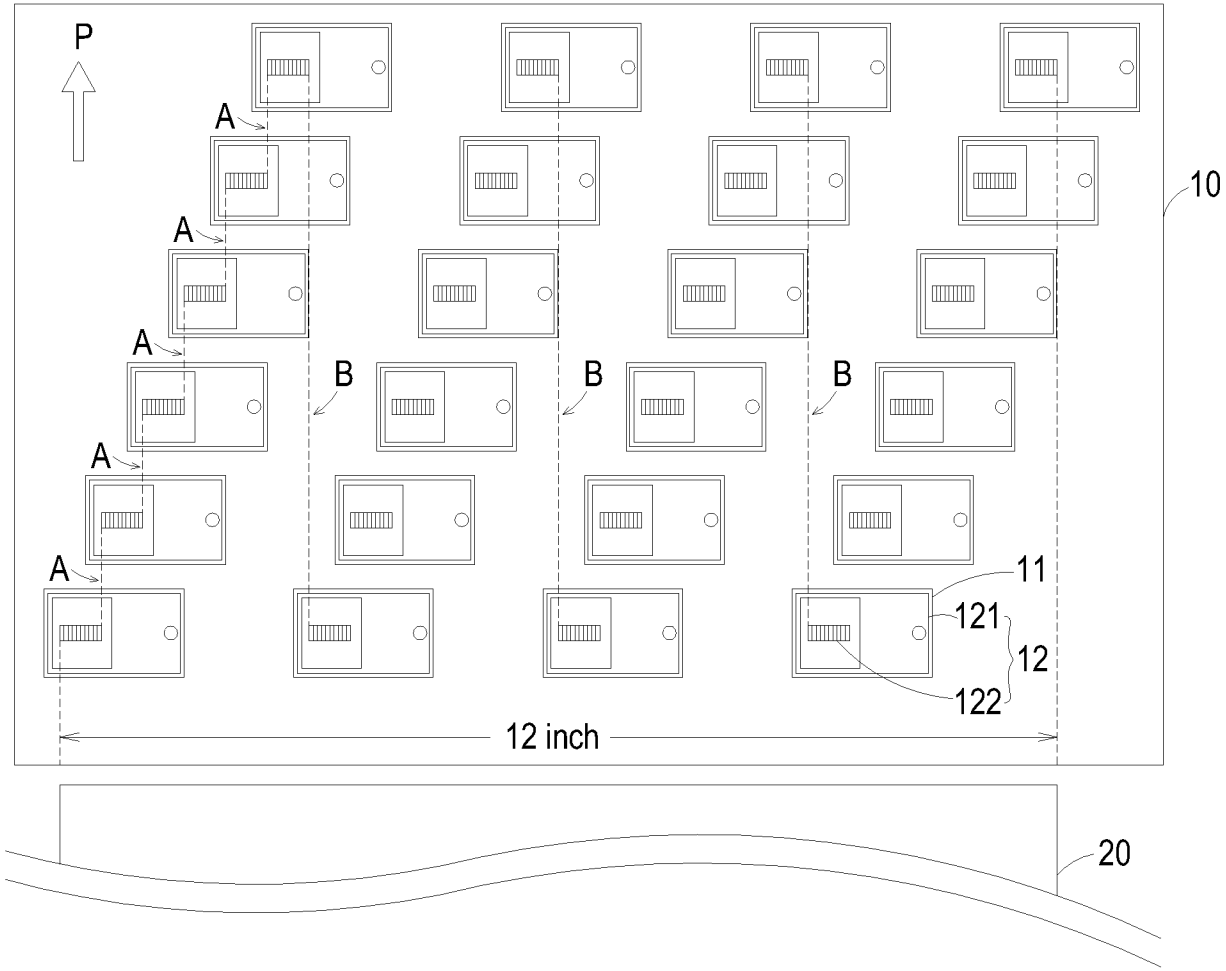
FIG. 2 shows another schematic view of an ink-jet printing module according to a preferred embodiment of the present invention.

Please refer to FIG. 2. In this embodiment, the color ink-jet cartridges 12 (such as including red, yellow and blue inks)

each having a chip size of ½ inch and a resolution of 1200 dpi are employed. As shown in FIG. 2, six ink-jet cartridges 12 are arranged in a row, and there are four rows of ink-jet cartridges 12 arranged in the printing direction (arrow P indicates the printing direction), so there are total twenty four ink-jet cartridges 12 disposed on the bottom of the page-width array platen 10. The ink-jet cartridges 12 are arranged to connect the ink-jet chips 122 thereof, so that the ink-jet chips 122 are distributed in the whole page width of the printing medium 20. More particularly, the adjacent ink-jet cartridges 12 in the same row are arranged in the way that the front end of the first (upper) ink jet chip 122 is aligned with the rear end of the second (lower) ink-jet chip 122 (the aligning line is shown as the dotted line A, which is perpendicular to the width direction of the printing medium 20). While in different rows, the ink-jet cartridges 12 are arranged in the way that the rear end of the last (uppermost) ink jet chip 122 in the first (left) row is aligned with the front end of the first (lowermost) ink jet chip 122 in the second (right) row (the aligning line is shown as the dotted line B, which is perpendicular to the width direction of the printing medium 20). Accordingly, when the twenty four ink-jet cartridges 12 are disposed on the page-width array platen 10 in four rows as described above, the maximum printing range is 12 inches, so that a 1200 dpi multi-color printing process can be performed on the printing medium 20 having a width of 11.7 inches (297 mm, equal to the width of A3 paper) in this page-width array platen 10. Furthermore, for completing a dot supplementing printing, a solution is to equip additional and same twenty four ink-jet cartridges 12 on the page-width array platen 10 in the downstream of printing direction. In other words, there are two sets of twenty four ink jet cartridges 12 disposed on the page-width array platen 10.

Embodiment 4

½ Inch & 600 dpi Color Ink-Jet Cartridge

Figure 3:
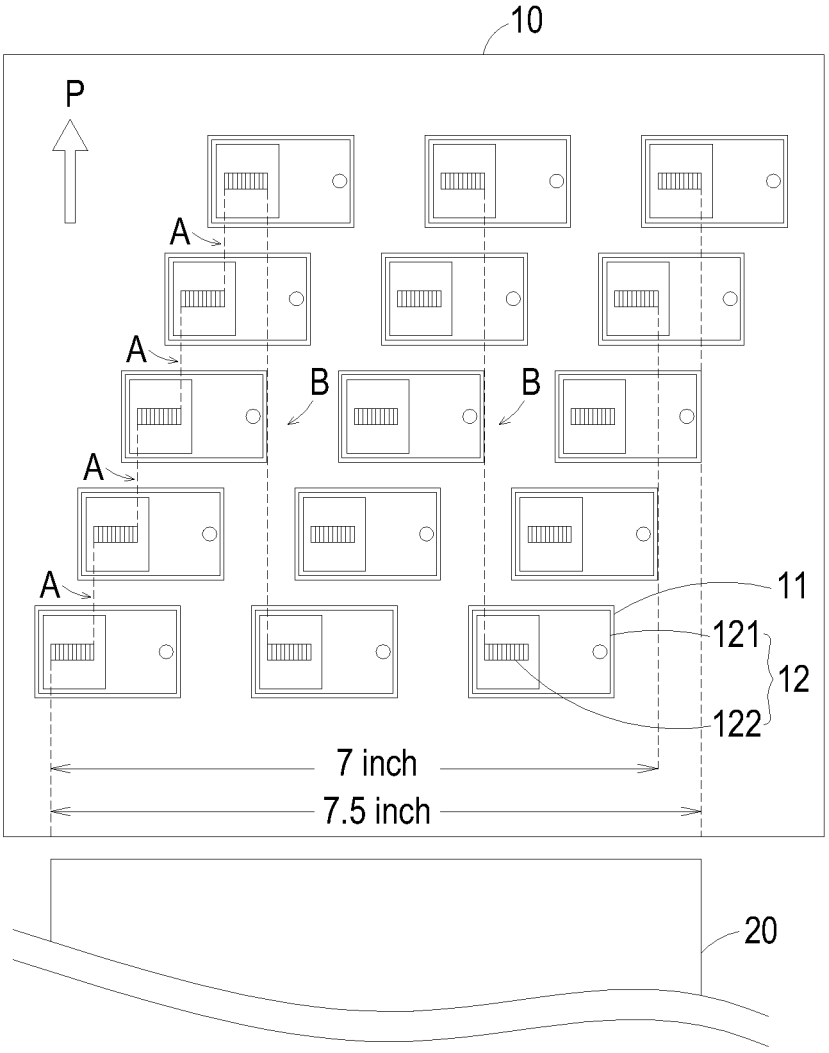
FIG. 3 shows an additional schematic view of an ink-jet printing module according to a preferred embodiment of the present invention.

Please refer to FIG. 3. In this embodiment, the color ink-jet cartridges 12 (such as including red, yellow and blue inks) each having a chip size of ½ inch and a resolution of 600 dpi are employed. As shown in FIG. 3, five ink-jet cartridges 12 are arranged in a row, and there are three rows of ink-jet cartridges 12 arranged in the printing direction (arrow P indicates the printing direction), so there are total fifteen ink-jet cartridges 12 disposed on the bottom of the page-width array platen 10. The ink-jet cartridges 12 are arranged to connect the ink-jet chips 122 thereof, so that the ink-jet chips 122 are distributed in the whole page width of the printing medium 20. More particularly, the adjacent ink-jet cartridges 12 in the same row are arranged in the way that the front end of the first (upper) ink jet chip 122 is aligned with the rear end of the second (lower) ink-jet chip 122 (the aligning line is shown as the dotted line A, which is perpendicular to the width direction of the printing medium 20). While in different rows, the ink-jet cartridges 12 are arranged in the way that the rear end of the last (uppermost) ink jet chip 122 in the first (left) row is aligned with the front end of the first (lowermost) ink jet chip 122 in the second (right) row (the aligning line is shown as the dotted line B, which is perpendicular to the width direction of the printing medium 20). Accordingly, when the fifteen ink-jet cartridges 12 are disposed on the page-width array platen 10 in three rows as described above, a 600 dpi multi-color printing process can be performed on the printing medium 20 having a width of 7.5 inches (191 mm) in this page-width array platen 10. Furthermore, for completing a dot supplementing printing, a solution is to equip additional and same fifteen ink-jet cartridges 12 on the page-width array platen 10 in the downstream of printing direction. In other words, there are two sets of fifteen ink-jet cartridges 12 disposed on the page-width array platen 10.

Certainly, if the outermost ink-jet cartridge 12 of the last row (such as the most right and upper ink-jet cartridge 12 shown in FIG. 3) is removed, a 600 dpi multi-color printing process can be performed on the printing medium 20 having a width of 7 inches (178 mm).

Embodiment 5

½ Inch & 600 dpi Black Ink-Jet Cartridge

Figure 4:
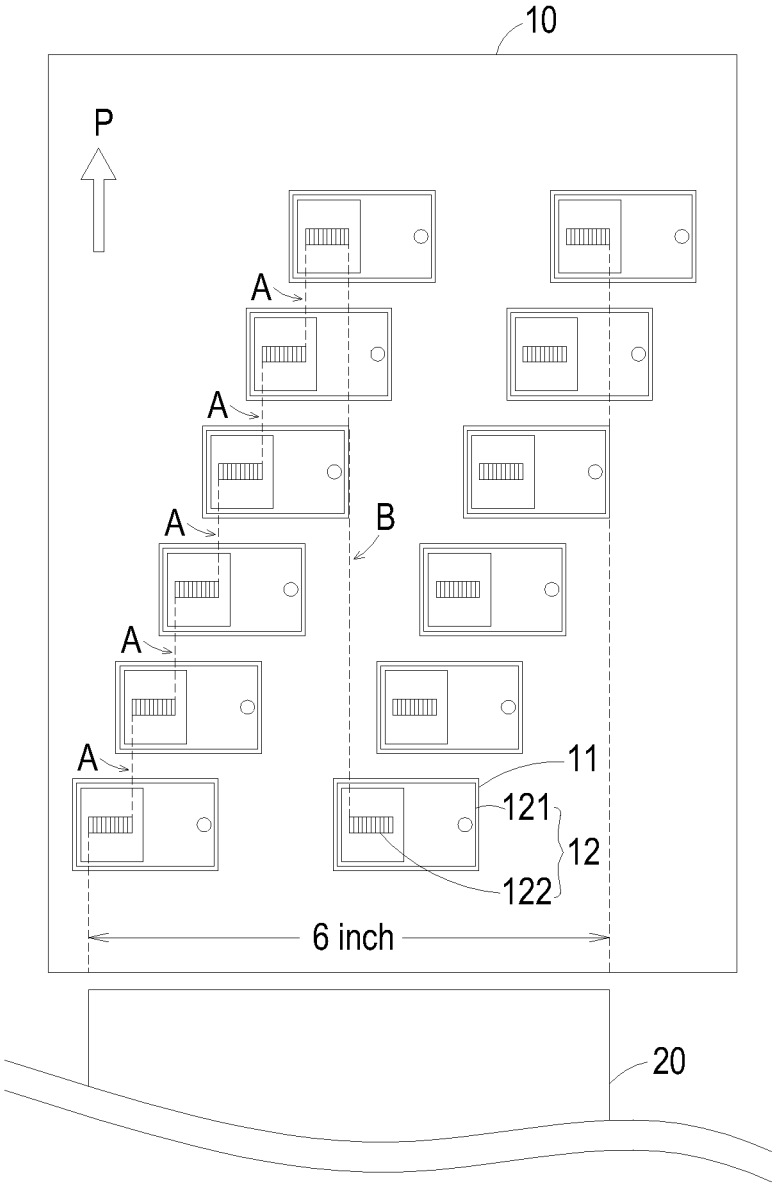
FIG. 4 shows an additional schematic view of an ink-jet printing module according to a preferred embodiment of the present invention.

Please refer to FIG. 4. In this embodiment, the black ink-jet cartridges 12 each having a chip size of ½ inch and a resolution of 600 dpi are employed. As shown in FIG. 4, six ink jet cartridges 12 are arranged in a row, and there are two rows of ink-jet cartridges 12 arranged in the printing direction (arrow P indicates the printing direction), so there are total twelve ink-jet cartridges 12 disposed on the bottom of the page-width array platen 10. The ink jet cartridges 12 are arranged to connect the ink-jet chips 122 thereof, so that the ink-jet chips 122 are distributed in the whole page width of the printing medium 20. More particularly, the adjacent ink-jet cartridges 12 in the same row are arranged in the way that the front end of the first (upper) ink-jet chip 122 is aligned with the rear end of the second (lower) ink jet chip 122 (the aligning line is shown as the dotted line A, which is perpendicular to the width direction of the printing medium 20). While in different rows, the ink-jet cartridges 12 are arranged in the way that the rear end of the last (uppermost) ink-jet chip 122 in the first (left) row is aligned with the front end of the first (lowermost) ink-jet chip 122 in the second (right) row (the aligning line is shown as the dotted line B, which is perpendicular to the width direction of the printing medium 20). Accordingly, when the twelve ink jet cartridges 12 are disposed on the page-width array platen 10 in two rows as described above, a 600 dpi single-color printing process can be performed on the printing medium 20 having a width of 6 inches (152 mm) in this page-width array platen 10. Furthermore, for completing a dot supplementing printing, a solution is to equip additional and same twelve ink-jet cartridges 12 on the page-width array platen 10 in the downstream of printing direction. In other words, there are two sets of twelve ink-jet cartridges 12 disposed on the page-width array platen 10.

Embodiment 6

½ Inch & 600 dpi Black Ink-Jet Cartridge

Figure 5:
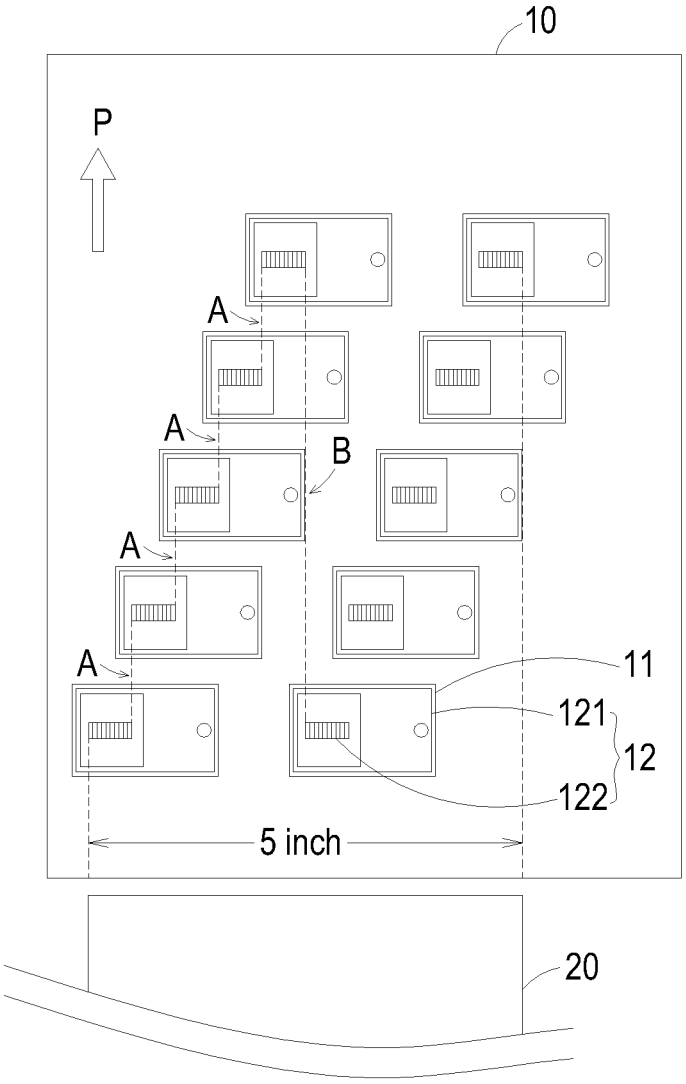
FIG. 5 shows an additional schematic view of an ink-jet printing module according to a preferred embodiment of the present invention.

Please refer to FIG. 5. In this embodiment, the black ink-jet cartridges 12 each having a chip size of ½ inch and a resolution of 600 dpi are employed. As shown in FIG. 5, five ink-jet cartridges 12 are arranged in a row, and there are two rows of ink-jet cartridges 12 arranged in the printing direction (arrow P indicates the printing direction), so there are total ten ink-jet cartridges 12 disposed on the bottom of the page-width array platen 10. The ink jet cartridges 12 are arranged to connect the ink-jet chips 122 thereof, so that the ink-jet chips 122 are distributed in the whole page width of the printing medium 20. More particularly, the adjacent ink-jet cartridges 12 in the same row are arranged in the way that the front end of the first (upper) ink-jet chip 122 is aligned with the rear end of the second (lower) ink jet chip 122 (the aligning line is shown as the dotted line A, which is perpendicular to the width direction of the printing medium 20). While in different rows, the ink-jet cartridges 12 are arranged in the way that the rear end of the last (uppermost) ink-jet chip 122 in the first (left) row is aligned with the front end of the first (lowermost) ink-jet chip 122 in the second (right) row (the aligning line is shown as the dotted line B, which is perpendicular to the width direction of the printing medium 20). Accordingly, when the ten ink-jet cartridges 12 are disposed on the page-width array platen 10 in two rows as described above, a 600 dpi single-color printing process can be performed on the printing medium 20 having a width of 5 inches (127 mm) in this page-width array platen 10. Furthermore, for completing a dot supplementing printing, a solution is to equip additional and same ten ink-jet cartridges 12 on the page-width array platen 10 in the downstream of printing direction. In other words, there are two sets of ten ink-jet cartridges 12 disposed on the page-width array platen 10.

Embodiment 7

¼ Inch & 600 dpi Color Ink-Jet Cartridge

Figure 6:
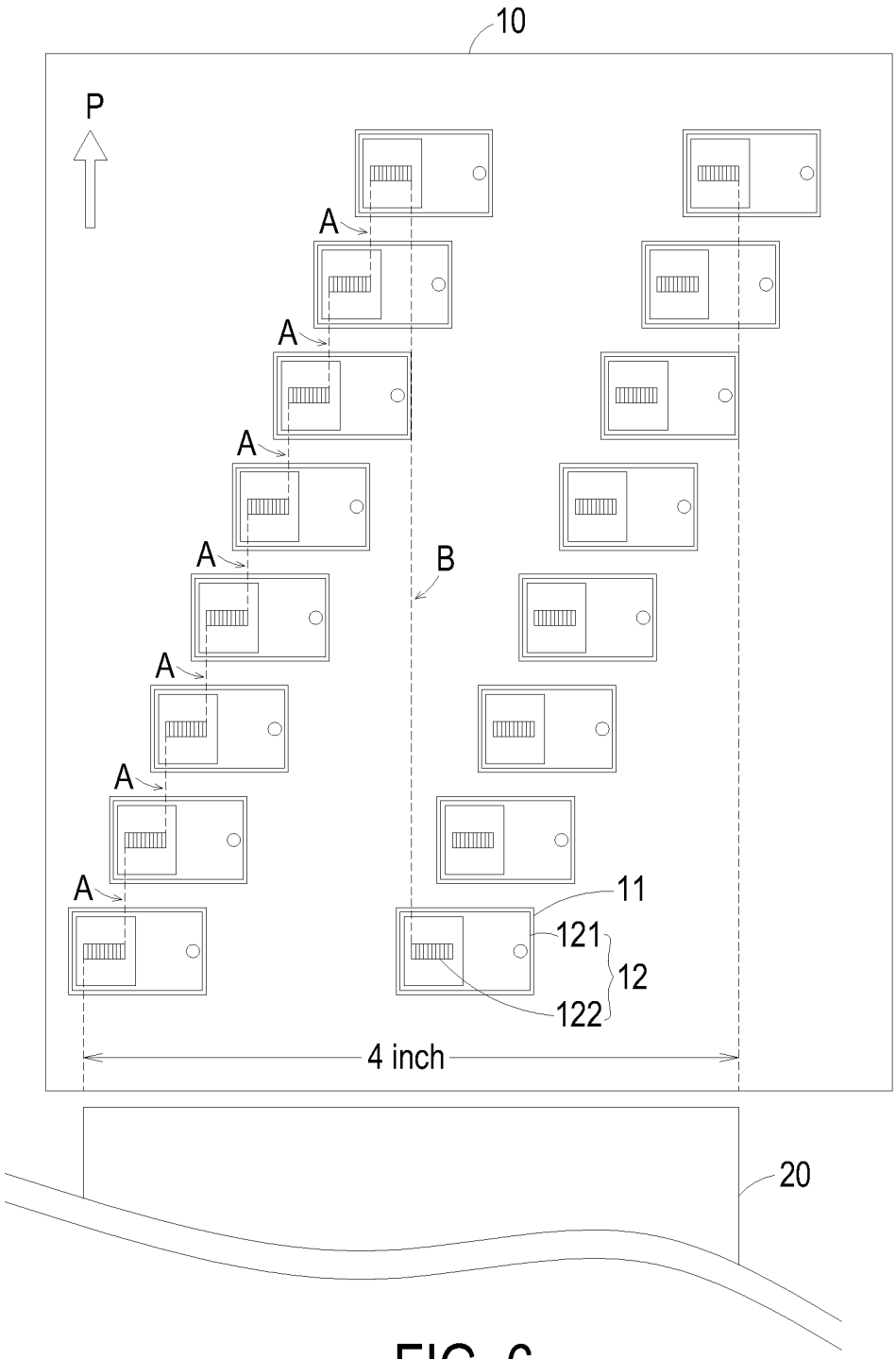
FIG. 6 shows an additional schematic view of an ink-jet printing module according to a preferred embodiment of the present invention.

Please refer to FIG. 6. In this embodiment, the color ink-jet cartridges 12 (such as including red, yellow and blue inks) each having a chip size of ¼ inch and a resolution of 600 dpi are employed. As shown in FIG. 6, eight ink-jet cartridges 12 are arranged in a row, and there are two rows of ink-jet cartridges 12 arranged in the printing direction (arrow P indicates the printing direction), so there are total sixteen ink-jet cartridges 12 disposed on the bottom of the page-width array platen 10. The ink-jet cartridges 12 are arranged to connect the ink-jet chips 122 thereof, so that the ink-jet chips 122 are distributed in the whole page width of the printing medium 20. More particularly, the adjacent ink-jet cartridges 12 in the same row are arranged in the way that the front end of the first (upper) ink-jet chip 122 is aligned with the rear end of the second (lower) ink-jet chip 122 (the aligning line is shown as the dotted line A, which is perpendicular to the width direction of the printing medium 20). While in different rows, the ink-jet cartridges 12 are arranged in the way that the rear end of the last (uppermost) ink-jet chip 122 in the first (left) row is aligned with the front end of the first (lowermost) ink-jet chip 122 in the second (right) row (the aligning line is shown as the dotted line B, which is perpendicular to the width direction of the printing medium 20). Accordingly, when the sixteen ink-jet cartridges 12 are disposed on the page-width array platen 10 in two rows as described above, a 600 dpi multi-color printing process can be performed on the printing medium 20 having a width of 4 inches (102 mm) in this page-width array platen 10. Furthermore, for completing a dot supplementing printing, a solution is to equip additional and same sixteen ink-jet cartridges 12 on the page-width array platen 10 in the downstream of printing direction. In other words, there are two sets of sixteen ink-jet cartridges 12 disposed on the page-width array platen 10.

Embodiment 8

⅙ Inch & 300 dpi Black Ink-Jet Cartridge

Figure 7:
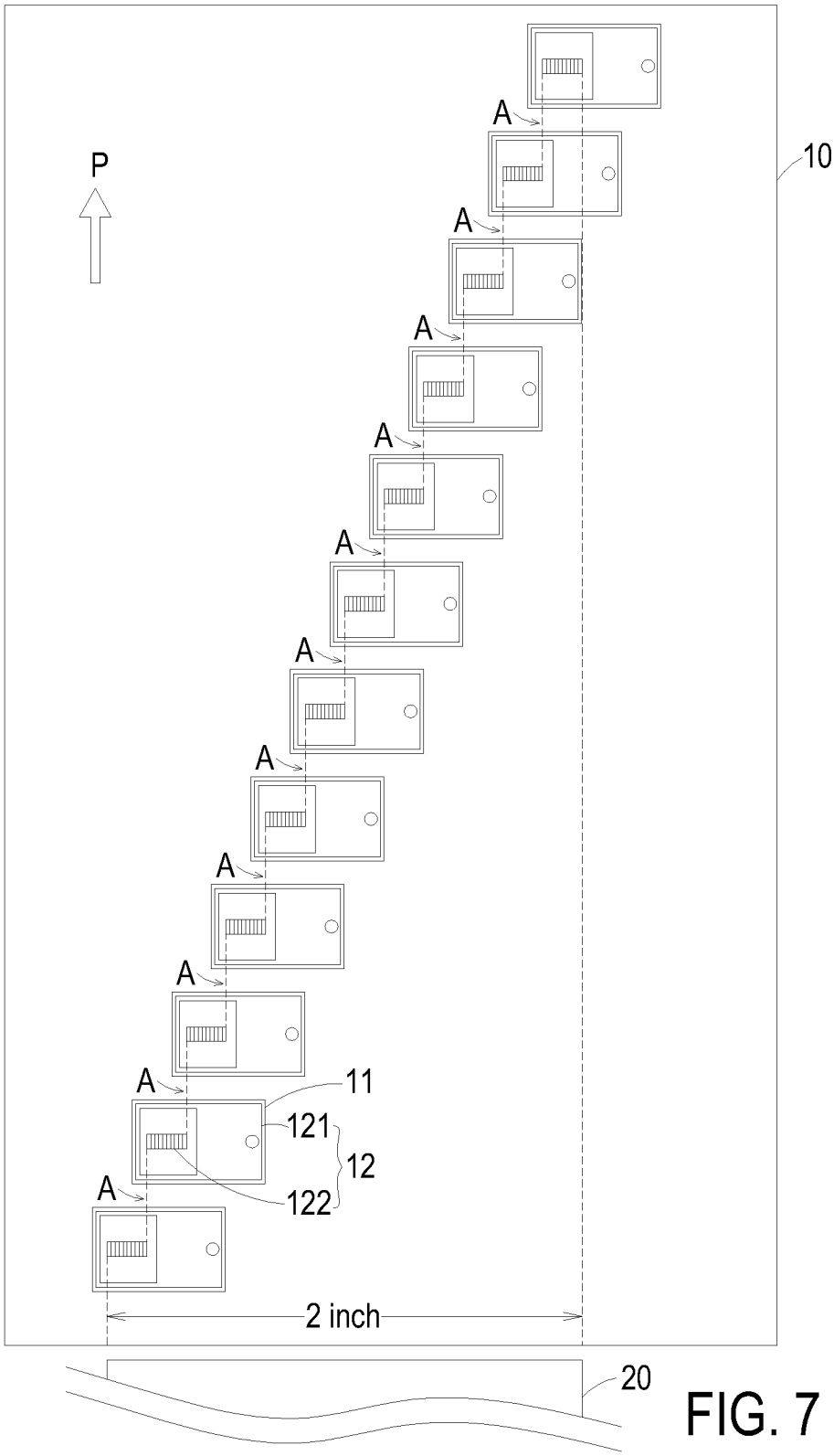
FIG. 7 shows an additional schematic view of an ink-jet printing module according to a preferred embodiment of the present invention.

Please refer to FIG. 7. In this embodiment, the black ink-jet cartridges 12 each having a chip size of ⅙ inch and a resolution of 300 dpi are employed. As shown in FIG. 7, twelve ink-jet cartridges 12 are arranged in a row, and there are only one row of ink-jet cartridges 12 arranged in the printing direction (arrow P indicates the printing direction), so there are total twelve ink-jet cartridges 12 disposed on the bottom of the page-width array platen 10. The ink-jet cartridges 12 are arranged to connect the ink-jet chips 122 thereof, so that the ink-jet chips 122 are distributed in the whole page width of the printing medium 20. More particularly, the adjacent ink-jet cartridges 12 in the same row are arranged in the way that the front end of the first (upper) ink-jet chip 122 is aligned with the rear end of the second (lower) ink-jet chip 122 (the aligning line is shown as the dotted line A, which is perpendicular to the width direction of the printing medium 20). Accordingly, when the twelve ink jet cartridges 12 are disposed on the page-width array platen 10 in one row as described above, a 300 dpi single-color printing process can be performed on the printing medium 20 having a width of 2 inches (51 mm) in this page-width array platen 10. Furthermore, for completing a dot supplementing printing, a solution is to equip additional and same twelve ink-jet cartridges 12 on the page-width array platen 10 in the downstream of printing direction. In other words, there are two sets of twelve ink-jet cartridges 12 disposed on the page-width array platen 10.

Embodiment 9

½ Inch & 300 dpi Black Ink-Jet Cartridge

Figure 8:
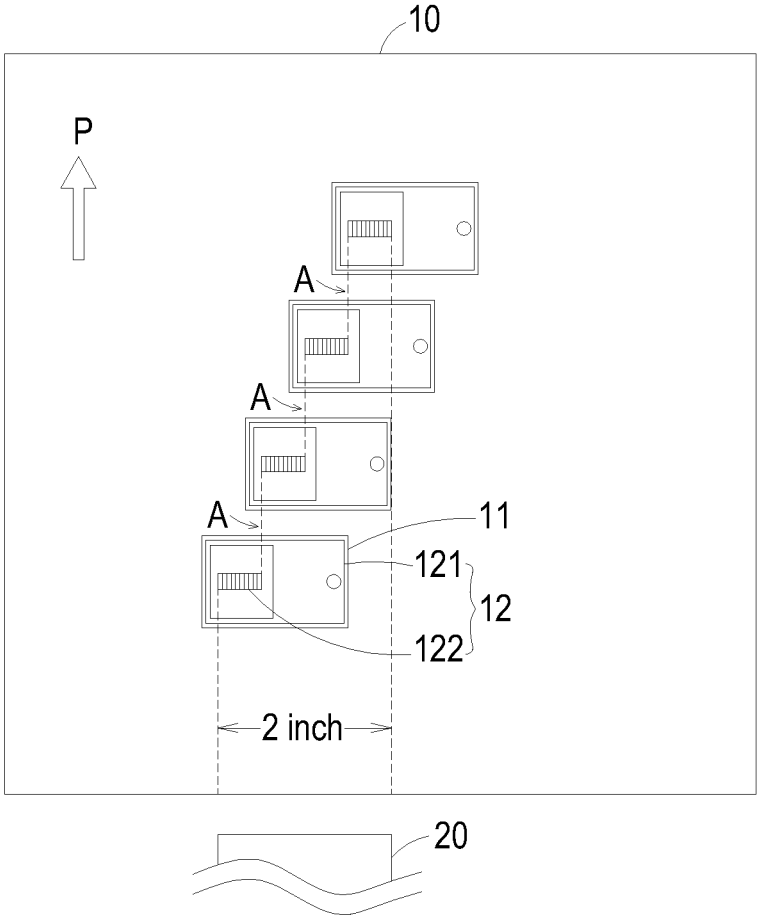
FIG. 8 shows an additional schematic view of an ink-jet printing module according to a preferred embodiment of the present invention.

Please refer to FIG. 8. In this embodiment, the black ink-jet cartridges 12 each having a chip size of ½ inch and a resolution of 300 dpi are employed. As shown in FIG. 8, four ink-jet cartridges 12 are arranged in a row, and there are only one row of ink-jet cartridges 12 arranged in the printing direction (arrow P indicates the printing direction), so there are total four ink-jet cartridges 12 disposed on the bottom of the page-width array platen 10. The ink jet cartridges 12 are arranged to connect the ink-jet chips 122 thereof, so that the ink-jet chips 122 are distributed in the whole page width of the printing medium 20. More particularly, the adjacent ink-jet cartridges 12 in the same row are arranged in the way that the front end of the first (upper) ink-jet chip 122 is aligned with the rear end of the second (lower) ink jet chip 122 (the aligning line is shown as the dotted line A, which is perpendicular to the width direction of the printing medium 20). Accordingly, when the four ink-jet cartridges 12 are disposed on the page-width array platen 10 in one row as described above, a 300 dpi single-color printing process can be performed on the printing medium 20 having a width of 2 inches (51 mm) in this page-width array platen 10. Furthermore, for completing a dot supplementing printing, a solution is to equip additional and same four ink-jet cartridges 12 on the page-width array platen 10 in the downstream of printing direction. In other words, there are two sets of four ink jet cartridges 12 disposed on the page-width array platen 10.

Embodiment 10

¼ Inch & 300 dpi Black Ink-Jet Cartridge

Figure 9:
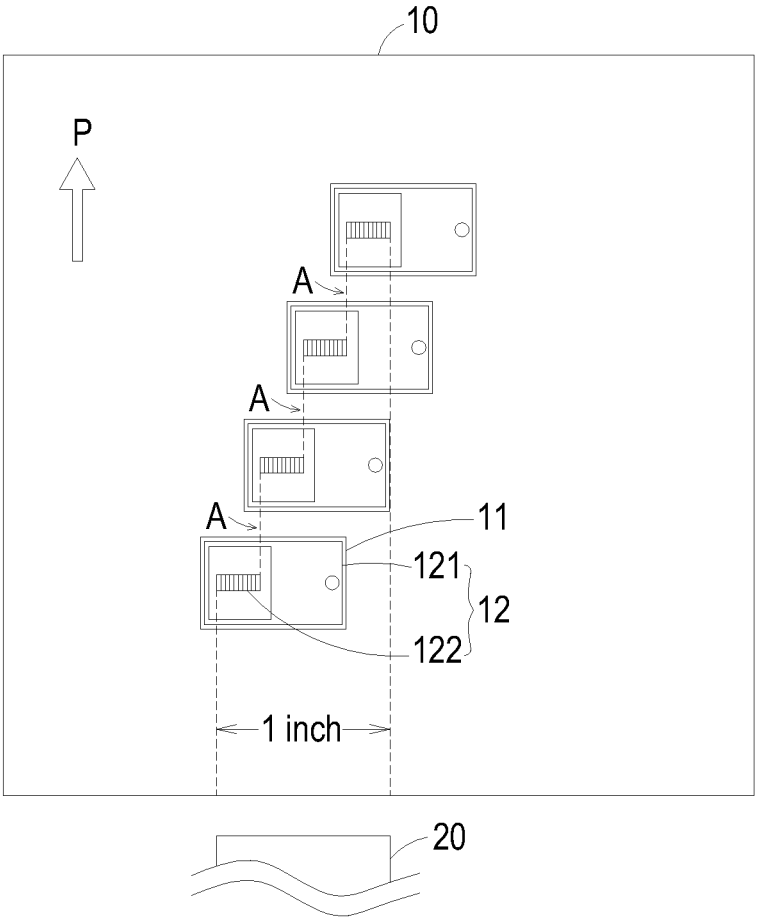
FIG. 9 shows an additional schematic view of an ink-jet printing module according to a preferred embodiment of the present invention.

Please refer to FIG. 9. In this embodiment, the black ink-jet cartridges 12 each having a chip size of ¼ inch and a resolution of 300 dpi are employed. As shown in FIG. 9, four ink-jet cartridges 12 are arranged in a row, and there are only one row of ink-jet cartridges 12 arranged in the printing direction (arrow P indicates the printing direction), so there are total four ink-jet cartridges 12 disposed on the bottom of the page-width array platen 10. The ink jet cartridges 12 are arranged to connect the ink-jet chips 122 thereof, so that the ink-jet chips 122 are distributed in the whole page width of the printing medium 20. More particularly, the adjacent ink-jet cartridges 12 in the same row are arranged in the way that the front end of the first (upper) ink-jet chip 122 is aligned with the rear end of the second (lower) ink jet chip 122 (the aligning line is shown as the dotted line A, which is perpendicular to the width direction of the printing medium 20). Accordingly, when the four ink-jet cartridges 12 are disposed on the page-width array platen 10 in one row as described above, a 300 dpi single-color printing process can be performed on the printing medium 20 having a width of 1 inch (25 mm) in this page-width array platen 10. Furthermore, for completing a dot supplementing printing, a solution is to equip additional and same four ink-jet cartridges 12 on the page-width array platen 10 in the downstream of printing direction. In other words, there are two sets of four ink-jet cartridges 12 disposed on the page-width array platen 10.

Certainly, the chip size used in the ink-jet printing module of the present invention is not limited to ⅙, ¼ and ½ inch as described above, and other bigger chip sizes, such as 1, 2, 3 inches or above can also be used. The chip size is counted substantially by the distance between the first nozzle and the last nozzle on the chip, i.e. the distance between the two nozzles which are closest to the two opposite sides of the chip. Since the two nozzles which are closest to the two opposite sides of the chip are very close to the sides of the chip, the distance therebetween is substantially equal to the length of the chip. In addition, the resolution of the chip can be adjusted according to the printing requirement; except 300, 600 and 1200 dpi as described above, the chip has other resolution such as 2400 dpi or above can also be used in the present invention.

From the above, it is clear that the ink-jet printing module of the present invention is applied to the page-width array platen which is provided with a plurality of receiving cavities arranged as an array, each of which is used for independently carrying a single ink-jet cartridge, and the ink-jet chip disposed on the bottom of the page-width array platen is driven to eject ink onto the printing medium, so as to complete a page-width array printing. Therefore, by adjusting the arrangement of the ink-jet cartridges, such as adjusting the amount and the arranging width of the ink-jet cartridges, various printing requirements for different sizes of the printing mediums can be satisfied. Also, according to different resolution requirements, the original ink-jet cartridges can be directly dissembled and replaced with the ink-jet cartridges having required resolution, so as to improve the printing quality. Of course, each independent ink-jet cartridge can be connected to a continuous ink-supplying channel so as to perform a continuous printing process.

Moreover, the ink-jet printing module of the present invention includes the plurality of ink-jet cartridges, each of which is independently embedded into one of the receiving cavities on the page-width array platen, so it does not need a complicated ink channel system for supplying the ink. Besides, when the ink in the ink-jet cartridge is running out or the ink-jet chip is damaged, the particular ink-jet cartridge which is out of order can be directly dissembled and replaced with a new one. Each independent ink-jet cartridge can be carried and positioned in the receiving cavity on the page-width array platen by a carrying seat, and the vertical sidewall of the receiving cavity can be provided for the layout of the control node circuits. Since an additional 2-dimensional area is further provided for the layout of the control node circuits and the circuit layout area is accordingly increased, the circuit layout does not need to be arranged and controlled in a complicated way, and thus, the manufacturing process can be simplified.

In conclusion, the ink-jet printing module of the present invention employs the plurality of ink-jet cartridges to be independently carried on the page-width array platen, and this modularized design solves the problem that the whole printing platen has to be changed when one of the ink-jet chips is damaged in the conventional page-width array ink-jet printer. According to the design of the present invention, the page-width array platen is more convenient in assembling, ink filling and cartridge changing, and has advantage of reducing the cost. Furthermore, the arrangement of the ink-jet cartridges can be adjusted so as to conform to the various requirements of different printing sizes and resolutions for completing a required page-width array printing process.

While the invention has been described in terms of what is presently considered to be the most practical and preferred embodiments, it is to be understood that the invention needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. An ink-jet printing module used for a page-width array ink-jet printer, said ink-jet printing module comprising:

a page-width array platen having a plurality of receiving cavities arranged as an array; and a plurality of ink-jet cartridges, each of which being detachably and independently embedded into one of said receiving cavities, and including a body for storing ink, an ink-jet chip to be driven for ejecting said ink, a plurality of nozzles disposed on said ink-jet chip, and a control node for receiving signal to drive said ink-jet chip, wherein said ink-jet chip is disposed on a bottom of said page-width array platen and is driven to eject said ink through said nozzles onto a printing medium, said plurality of ink-jet cartridges are arranged in at least one row along a printing direction, any two adjacent ink-jet cartridges are spaced from each other, each of said plurality of ink-jet cartridges is partly offset with other ink-jet cartridges in the same row, and a page-width array printing range of said ink-jet printing module for printing on said printing medium is 8.27 inches (A4 size).

2. The ink-jet printing module according to claim 1, wherein adjacent ink-jet cartridges in the same row are arranged in a way that a front end of a first ink-jet chip is aligned with a rear end of a second ink-jet chip.

3. The ink-jet printing module according to claim 2, wherein in different rows, said ink-jet cartridges are arranged in a way that a rear end of a last ink-jet chip in a first row is aligned with a front end of a first ink-jet chip in a second row.

4. The ink-jet printing module according to claim 1, wherein a size of said ink-jet chip is at least 3 inches.

5. The ink-jet printing module according to claim 1, wherein a size of said ink-jet chip is between ½ and 2 inches.

6. The ink-jet printing module according to claim 1, wherein a size of said ink-jet chip is between ¼ and ½ inch.

7. The ink-jet printing module according to claim 1, wherein a size of said ink-jet chip is between ⅙ and ¼ inch.

8. The ink-jet printing module according to claim 1, wherein each of said plurality of ink-jet cartridges is connected to a continuous ink-supplying channel so as to perform a continuous printing process.

9. The ink-jet printing module according to claim 1, wherein a resolution of said ink-jet chip is at least 2400 dpi.

10. The ink-jet printing module according to claim 1, wherein a resolution of said ink-jet chip is between 1200 and 2400 dpi.

11. The ink-jet printing module according to claim 1, wherein a resolution of said ink-jet chip is between 600 and 1200 dpi.

12. The ink-jet printing module according to claim 1, wherein a resolution of said ink-jet chip is between 300 and 600 dpi.

13. The ink-jet printing module according to claim 1, wherein a page-width array printing range of said ink-jet printing module for printing on said printing medium is 11.7 inches (A3 size).

14. The ink-jet printing module according to claim 1, wherein a page-width array printing range of said ink-jet printing module for printing on said printing medium comprises at least 1 to 7 inches.

15. The ink-jet printing module according to claim 1, wherein a page-width array printing range of said ink-jet printing module for printing on said printing medium is 1 inch.

16. The ink-jet printing module according to claim 1, wherein a page-width array printing range of said ink-jet printing module for printing on said printing medium is 2 inches.

17. The ink-jet printing module according to claim 1, wherein a page-width array printing range of said ink-jet printing module for printing on said printing medium is 4 inches.

18. The ink-jet printing module according to claim 1, wherein a page-width array printing range of said ink-jet printing module for printing on said printing medium is 6 inches.

19. The ink-jet printing module according to claim 1, wherein a page-width array printing range of said ink-jet printing module for printing on said printing medium is 7 inches.

20. An ink-jet printing module used for a page-width array ink-jet printer, said ink-jet printing module comprising:

a page-width array platen having a plurality of receiving cavities arranged as an array;

a plurality of ink-jet cartridges, each of which being detachably and independently embedded into one of said receiving cavities, and including a body for storing ink, an ink-jet chip to be driven for ejecting said ink, a plurality of nozzles disposed on said ink-jet chip, and a control node for receiving signal to drive said ink-jet chip, wherein said ink-jet chip is disposed on a bottom of said page-width array platen and is driven to eject said ink through said nozzles onto a printing medium; and a plurality of control node circuits disposed on vertical sidewalls of said receiving cavities on said page-width array platen and corresponding to said control nodes of said ink-jet cartridges for transmitting signal to said ink-jet chips of said ink-jet cartridges, so as to enable said ink-jet cartridges to eject said ink onto said printing medium, said plurality of ink-jet cartridges are arranged in at least one row along a printing direction, any two adjacent ink-jet cartridges are spaced from each other, each of said plurality of ink-jet cartridges is partly offset with other ink-jet cartridges in the same row, and a page-width array printing range of said ink-jet printing module for printing on said printing medium is 8.27 inches (A4 size).

21. The ink-jet printing module according to claim 20, wherein said plurality of control node circuits are formed as a soft circuit board.

* * * * *